United States Patent [19]

Papouchis

[11] Patent Number: 4,597,590

[45] Date of Patent: Jul. 1, 1986

[54] PROTECTIVE WRAPPER FOR PRINTED MATERIAL

[76] Inventor: George A. Papouchis, 604 E. Lincoln Way, Ames, Iowa 50010

[21] Appl. No.: 689,061

[22] Filed: Jan. 7, 1985

[51] Int. Cl.[4] ..... B42D 3/04; B42D 3/00

[52] U.S. Cl. ..... 281/34; 281/31

[58] Field of Search ..... 281/4, 19 R, 20, 31, 281/34; 229/16 A; 235/462

[56] References Cited

U.S. PATENT DOCUMENTS

| | | | |
|---|---|---|---|
| 2,150,474 | 3/1939 | Williams | 281/31 |
| 2,246,397 | 6/1941 | Traum | 281/34 |
| 2,737,220 | 3/1956 | Hoff | 281/34 |
| 2,757,939 | 8/1956 | Fenkel | 281/34 |
| 2,852,275 | 9/1958 | Brook | 281/31 |
| 3,372,858 | 3/1968 | Brody | 281/31 |
| 4,359,633 | 11/1982 | Bianco | 235/462 |

*Primary Examiner*—Paul A. Bell
*Assistant Examiner*—Paul M. Heyrana, Sr.
*Attorney, Agent, or Firm*—G. Brian Pingel; Kent A. Herink

[57] ABSTRACT

A protective wrapper for printed material includes an opaque cover into which the material is removably inserted and which conceals the identity of the material. Price information on the outside of the material is displayed through a small window in the cover. A tab having a foldable or removable portion projecting over a free edge of the cover is attached to or forms part of the cover. The identity of the material is initially displayed on the foldable portion of the tab. A purchaser of the material may conceal its identity from the general public view without hindering the purchasing process by folding the tab under the cover or removing the tab.

2 Claims, 3 Drawing Figures

FIG. 1
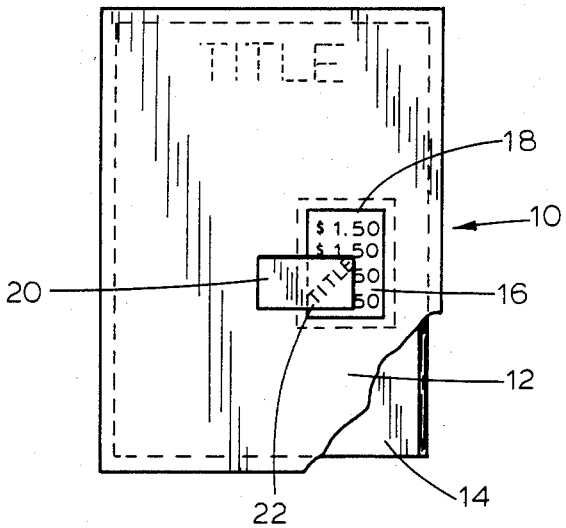
FIG. 2
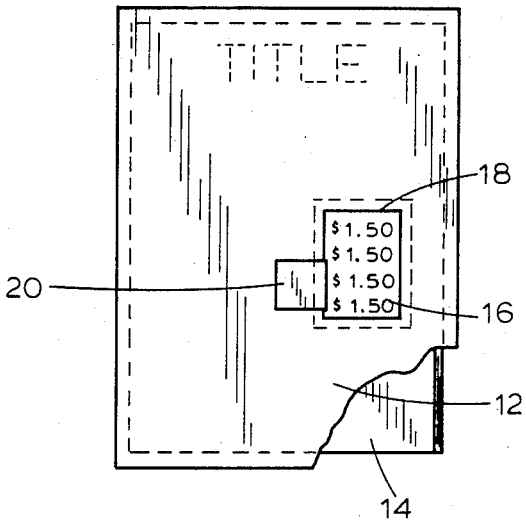
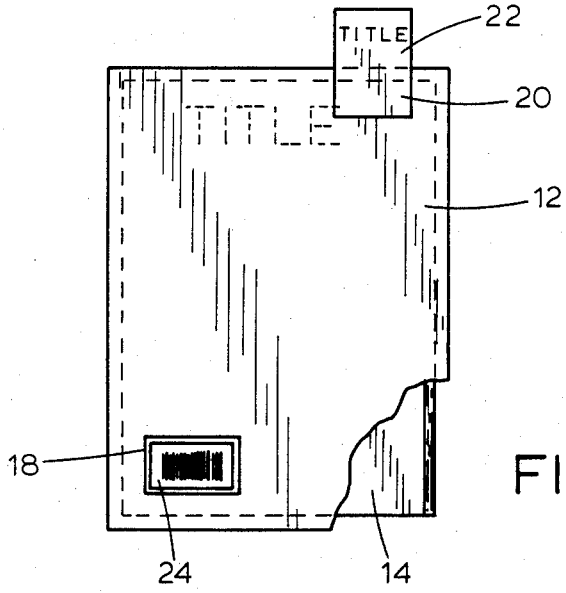
FIG. 3

PROTECTIVE WRAPPER FOR PRINTED MATERIAL

BACKGROUND OF THE INVENTION

The present invention relates to covers for protecting the confidentiality of printed material and, more specifically, to a removable cover for magazines having an identity displaying tab which is removed from display by a purchaser.

Printed material easily identifiable by its cover is commonly sold from display racks for selection by customers. Potential purchasers may be disuaded from or embarrassed by the purchase of certain printed material or magazines due to the nature of the content of the material. Sales of such potentially embarrassing material will be enhanced by means which will enable potential purchasers to identify easily the printed material of choice, but which will protect the confidentiality of the material when presented to a sales person for purchase. Further, some merchants prefer to conceal the frequently provocative covers of such material from the view of their customers who might otherwise find the display of the material offensive.

SUMMARY OF THE INVENTION

The present invention is a removable cover for protecting the confidentiality of printed material selected from a display by a purchaser. The price of the material is attached to the outside of the material by a label or other suitable means. An opaque cover is placed over the material, hiding the identity of the material. A window in the cover permits the price information to be viewed through the cover. The identity of the material while on display is carried on a foldable or removable portion of a tab attached to or forming part of the cover. The foldable portion is folded under by a purchaser to conceal the identity of the material. The price information remains in view to facilitate the purchasing process.

DESCRIPTION OF THE DRAWINGS

FIG. 1 is a plan view of a protective wrapper of the present invention with a corner broken away to illustrate a magazine;

FIG. 2 is a plan view of the present invention with the identifying tab folded under the edge of a price display window to conceal the identity of the printed material; and FIG. 3 is a plan view of another preferred embodiment of the invention wherein the identifying tab projects above the cover to display more prominently the identity of the printed material, and wherein coded price and identity information is displayed by a standard bar code label.

DETAILED DESCRIPTION OF A PREFERRED EMBODIMENT

Illustrated in FIG. 1, generally at 10, is a protective wrapper of the present invention, including a removable opaque cover 12, into which has been inserted a magazine 14. The wrapped magazine is intended to be publicly displayed for self-service purchasing by customers or potential purchasers. Attached to the front of the magazine 14 is a label 16, upon which has been printed the price of the magazine 14. The price of the magazine 14 is printed in a plurality of locations on the label 16. A window 18 in the cover 12 is formed by removing a small section of the cover 12 that would otherwise conceal the label 16. The price of the magazine 14, therefore, is displayed through the window 18. The plurality of price figures on the label 16 insure that at least one complete price figure is clearly visible through the window 18. The label 16 is removable from the front of the magazine 14 without damaging the appearance of the magazine 14.

The identity of the magazine 14 is concealed from a potential purchaser by the opaque cover 12. The invention contemplates, however, a tab 20 which ordinarily extends from the cover 12 into the area of the window 18 and over a portion of the exposed label 16. A foldable or removable portion 22 of the tab 20 displays the identity of the magazine 14. In this way, a potential purchaser can easily determine the identity of a wrapped magazine. The removable nature of the cover 12 permits a customer also to peruse the contents of a magazine by temporarily removing its cover 12. An unwrapped copy of the magazine 14 may also be displayed in front of copies protected by the wrapper 10. Customers could examine the unwrapped copy in deciding whether to purchase, and could then choose a wrapped copy for actual purchase.

Once the customer has made the decision to purchase the magazine 14, the identity of the magazine 14 can be concealed from the general public view by folding the foldable portion 22 of the tab 20 into the window 18 and under the edge of the cover 12, as illustrated in FIG. 2, or by removing the portion 22. Only the price of the magazine 14 on the label 16 is now displayed. This information is ordinarily sufficient to enable a sales clerk to complete the sale of the magazine 14 to the customer.

Another preferred embodiment of the protective wrapper 10 is illustrated in FIG. 3. This embodiment is adapted for use with printed material, or a magazine 14, which displays a machine readable bar code label 24. The window 18 in the cover 12 is now positioned over the bar code label 24. The window 18 permits the bar code label 24 to be read by the automatic pricing and inventory machines now in common use. As an alternative, the foldable tab 20 in this embodiment has a foldable or removable portion 22 which displays the identity of the magazine 14 more prominently above the top edge of the cover 12. Again, the foldable portion 22 is folded under or removed by the purchaser to conceal the identity of the purchased magazine 14.

It should be clear from the foregoing description of the preferred embodiment that other means could be employed in accomplishing the broad purposes of the invention. It should be understood that this description is intended to illustrate but not limit the scope of the invention as defined in the following claims.

I claim:

1. A protective wrapper for printed material that has pricing information on its cover and is displayed for purchase by a customer, comprising:

(a) a substantially opaque sleeve-type removable cover into which the printed material can be inserted to substantially shield the printed material from viewing as it is on display;

(b) a window in the cover through which price information can be displayed when the printed material is inside the removable cover said window being formed by the edges of a hole in said cover; and (c) means for displaying the identity of the printed material in association with said removable cover, which means is adjustable by a customer said displaying means comprising a foldable tab having an end portion, upon which the identity of the printed material can be displayed to protect the confidentiality of the identity of the covered printed material as it is being purchased.

2. The protective wrapper as defined in claim 1, wherein said end portion of said foldable tab is removable.

* * * * *